US005974610A

United States Patent [19]

Johnson et al.

[11] Patent Number: 5,974,610

[45] Date of Patent: Nov. 2, 1999

[54] COUNTERBALANCE WEIGHT FOR LAUNDRY WASHING MACHINE TUB

[75] Inventors: Troy A. Johnson, Newton, Iowa; Greg K. Harmelink, Moorhead, Minn.; Stephen D. Ostdiek, Newton, Iowa

[73] Assignee: Maytag Corporation, Newton, Iowa

[21] Appl. No.: 09/318,297

[22] Filed: May 25, 1999

Related U.S. Application Data

[62] Division of application No. 08/996,894, Dec. 23, 1997.

[51] Int. Cl.[6] ..... D06F 37/24

[52] U.S. Cl. ..... 8/159; 68/23.3; 248/632; 248/638

[58] Field of Search ..... 68/3 R, 23.3; 210/363, 210/364, 365; 206/320; 248/632, 638; 8/159

[56] References Cited

U.S. PATENT DOCUMENTS

| | | | |
|---|---|---|---|
| 1,991,793 | 2/1935 | Cureton | 68/23.3 |
| 2,361,767 | 10/1944 | Hays, Jr. | 68/23.3 |
| 3,334,497 | 8/1967 | Waldrop . | |
| 3,912,207 | 10/1975 | Gauer | 248/638 X |
| 4,403,484 | 9/1983 | Fey et al. | 68/23.3 |
| 5,056,341 | 10/1991 | Mori et al. | 248/638 X |
| 5,083,845 | 1/1992 | Sparks et al. | 206/320 X |
| 5,211,038 | 5/1993 | Valent | 68/23.2 |

FOREIGN PATENT DOCUMENTS

| | | | |
|---|---|---|---|
| 0 515 874 A1 | 12/1992 | European Pat. Off. . | |
| 051574 | 12/1992 | European Pat. Off. . | |
| 1144652 | 2/1963 | Germany | 210/364 |
| 1186413 | 1/1965 | Germany | 68/23.2 |
| 1414294 | 11/1975 | United Kingdom | 68/23.2 |
| 2 121 833A | 1/1984 | United Kingdom . | |
| 2121833 | 1/1984 | United Kingdom . | |
| 2 241 251 | 8/1991 | United Kingdom . | |
| 2241251 | 8/1991 | United Kingdom . | |

*Primary Examiner*—Philip R. Coe
*Attorney, Agent, or Firm*—Zarley, McKee, Thomte, Voorhees & Sease

[57] ABSTRACT

A counterbalance weight is provided for a laundry washing machine tub. The weight includes a weighted body securable to the tub with a foam impact-absorbing member mounted on the body in a position below the tub so as to absorb impact forces on the tub. The body of the counterbalance weight includes a pair of open slots adapted to receive bolts extending from the tub so as to slidably mount the counterbalance weight onto the tub. In an alternative embodiment, impact-absorbing members are provided on the bottom of a hung strut tub to absorb impact to the tub and to maintain the vibration-absorbing function of the strut springs.

9 Claims, 3 Drawing Sheets

COUNTERBALANCE WEIGHT FOR LAUNDRY WASHING MACHINE TUB

This is a division of copending application Ser. No. 08/996,894 filed on Dec. 23, 1997.

BACKGROUND OF THE INVENTION

A laundry washing machine tub typically has a counterbalance weight secured thereto in order to balance the tub during rotation. Such a counterweight typically is formed with one or more pieces of concrete secured to the tub with bolts or other fasteners. Some concrete counterweights are encased in plastic to prevent the concrete from breaking or chipping. However, known washing machine counterbalance weights are normally difficult to secure to the tub, thereby increasing the assembly time and manufacturing cost. Also, neither the tub nor the counterbalance weight includes any impact absorbing capability, which is particularly important during shipping or when excessively heavy loads are encountered during operation of the washing machine.

Therefore, a primary objective of the present invention is the provision of an improved counterbalance weight having an impact-absorbing member mounted thereon.

Another objective of the present invention is the provision of an improved counterbalance weight which is quickly and easily mounted to the tub of a washing machine.

A further objective of the present invention is the provision of a counterbalance weight having mounting slots for slideable mounting onto bolts fastened to the washing machine tub.

Another objective of the present invention is the provision of an improved counterbalance weight for a laundry washing machine which is economical to manufacture and durable and safe in use.

These and other objectives will become apparent from the following description of the invention.

SUMMARY OF THE INVENTION

The counterbalance weight of the present invention includes a weighted body secured to the washing machine tub, with an impact-absorbing member mounted on the body to absorb impact forces on the tub. Such impact forces may be generated during shipping or when the tub drops too far during operation in response to excessively heavy loads. Such impact forces are absorbed by the impact-absorbing member, thereby reducing or eliminating damage to the tub. The impact-absorbing member is preferably a foam material mounted on a tab of the counterbalance body.

The counterbalance body includes a plastic shell having one or more cavities filled with concrete. The shell includes a plurality of projections around which the concrete consolidates so as to provide a mechanical lock between the plastic shell and the concrete after the concrete has hardened. The body includes a pair of slots which extend through the shell from front to back, and which have open ends to laterally slide over bolts which are secured to the tub, thereby mounting the counterbalance weight to the tub.

DETAILED DESCRIPTION OF THE DRAWINGS

Figure 1:
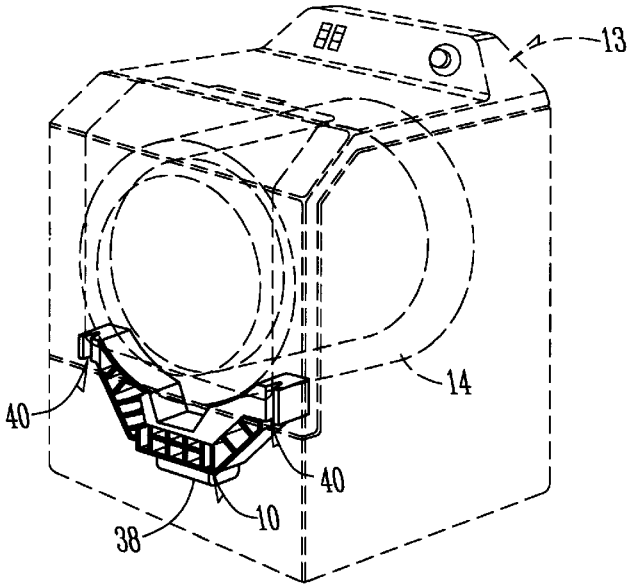
FIG. 1 is a perspective view of the counterbalance weight of the present invention mounted on a front loading washing machine.

The counterbalance weight of the present invention is generally designated in the drawings by the reference numeral 10. The counterbalance weight 10 includes a body 12 which is adapted to be mounted on a tub 14 of a laundry washing machine. The body 12 includes a back side 16, a front side 18, an inner or upper edge 20 and an outer or lower edge 22. The inner edge 20 has curved portions 24 so as to matingly engage the tub 14.

The body 12 is formed from a plastic shell 26 having cavities 28, 30 filled with concrete 32. Preferably, the cavities 28, 30 are spaced apart and connected by a flexible joint 34 so as to provide a degree of flexibility to the body 12.

A tab or flange 36 on the body 12 is adapted to retain an impact-absorbing member 38. Preferably, the impact-absorbing member 38 is made from a foam material, and includes a slot to receive the tab 36. When the counterbalance weight 10 is mounted on the tub 14, the member 38 is positioned below the tub. Thus, the impact-absorbing member 38 absorbs any shock to the tub during shipping. Also, during operation of the washing machine, the member 38 prevents the tub 14 from dropping or sagging too far from excessively heavy loads in the tub.

Figure 3:
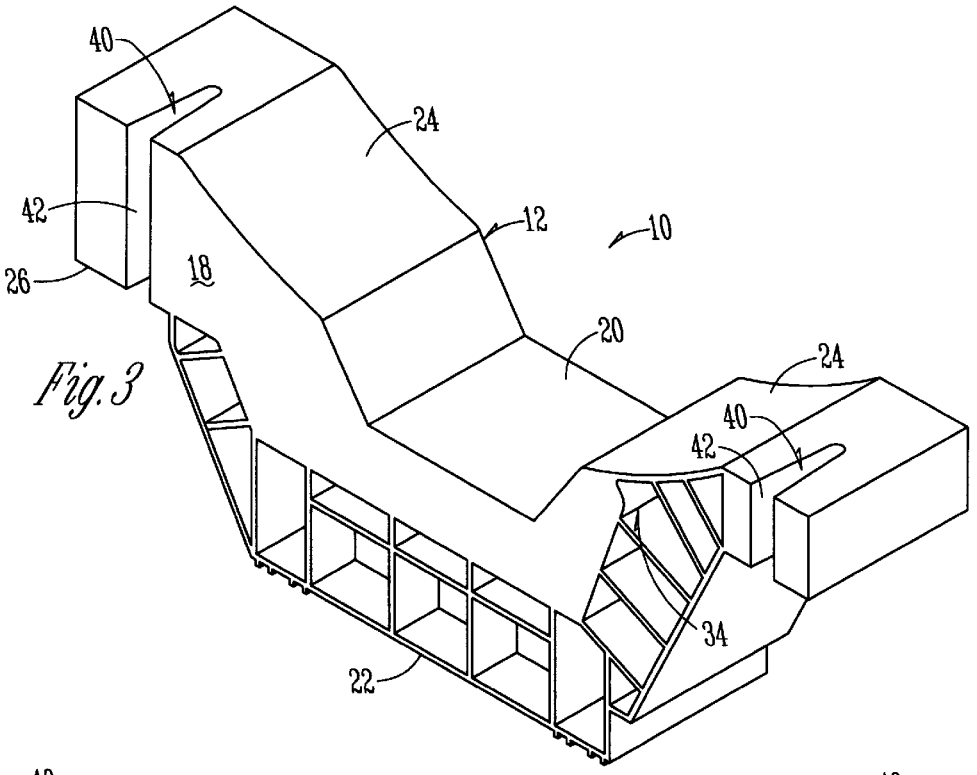
FIG. 3 is a perspective view of the plastic shell.
Figure 4:
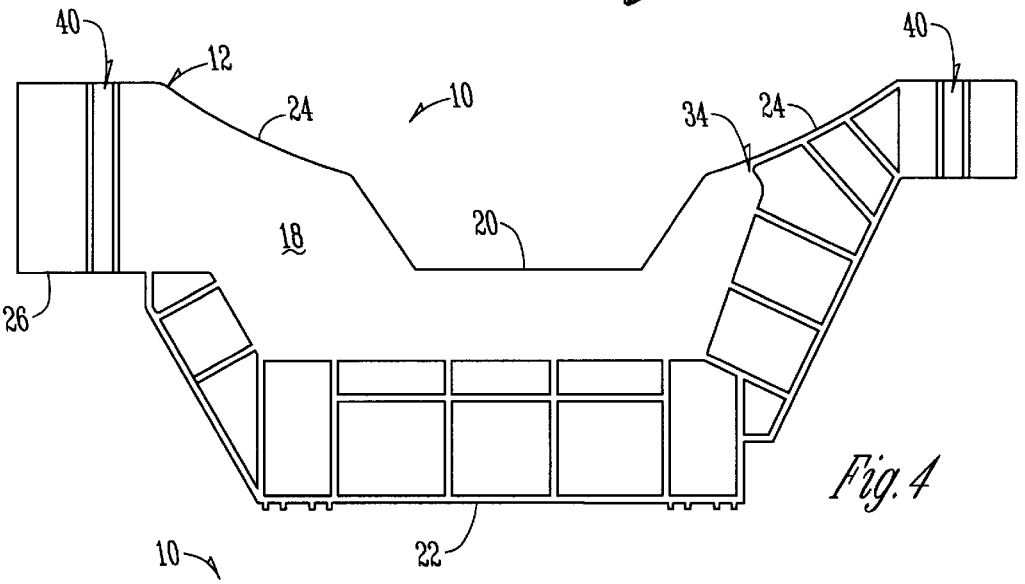
FIG. 4 is a front plan view of the plastic shell.
Figure 5:
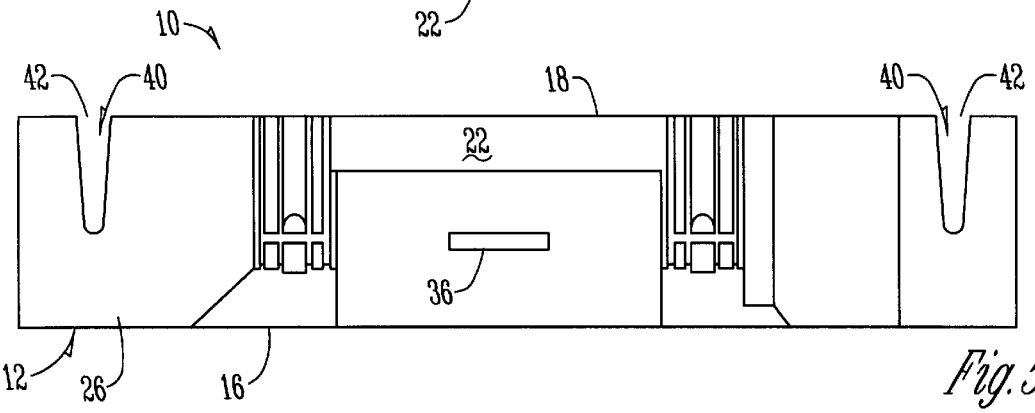
FIG. 5 is a bottom elevational view of the plastic shell.
Figure 6:
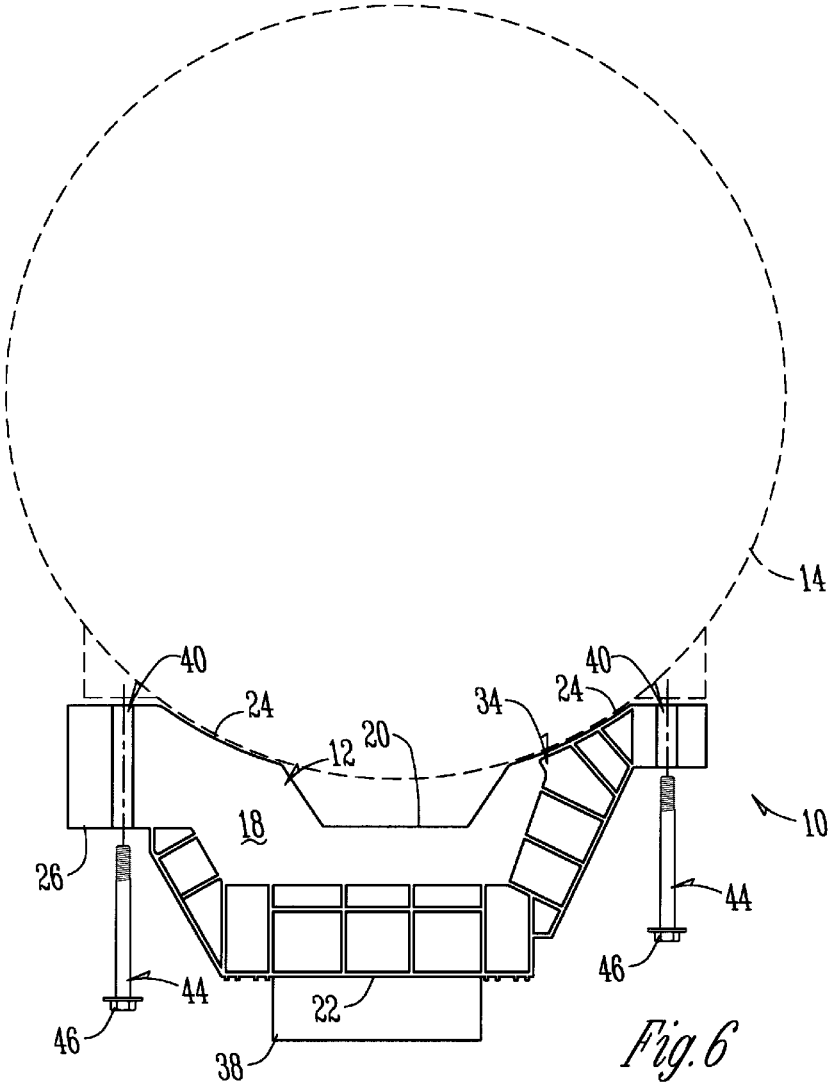
FIG. 6 is a front elevation view showing the counterbalance weight mounted on the tub of the front-loading washing machine.

The body 12 includes a pair of slots 40 for mounting the body 12 to the tub 14. More particularly, the slots 40 extend through the body 12 from the inner edge 20 to the outer edge 22, as best seen in FIGS. 3 and 5. The slots 40 include an open end 42 so as to be substantially U-shaped. Bolts 44 threadably secured to the tub 14 are adapted to slide laterally or radially through the open ends 42 of the slots 40, thereby quickly and easily mounting the counterbalance weight 10 onto the tub 14, as seen in FIG. 1. The head 46 of each bolt 44 supports the counterbalance weight 10. Since the tub is tilted approximately 15° from front to back, the weight 10 will be retained on the bolts 44 without additional attachments.

Figure 2:
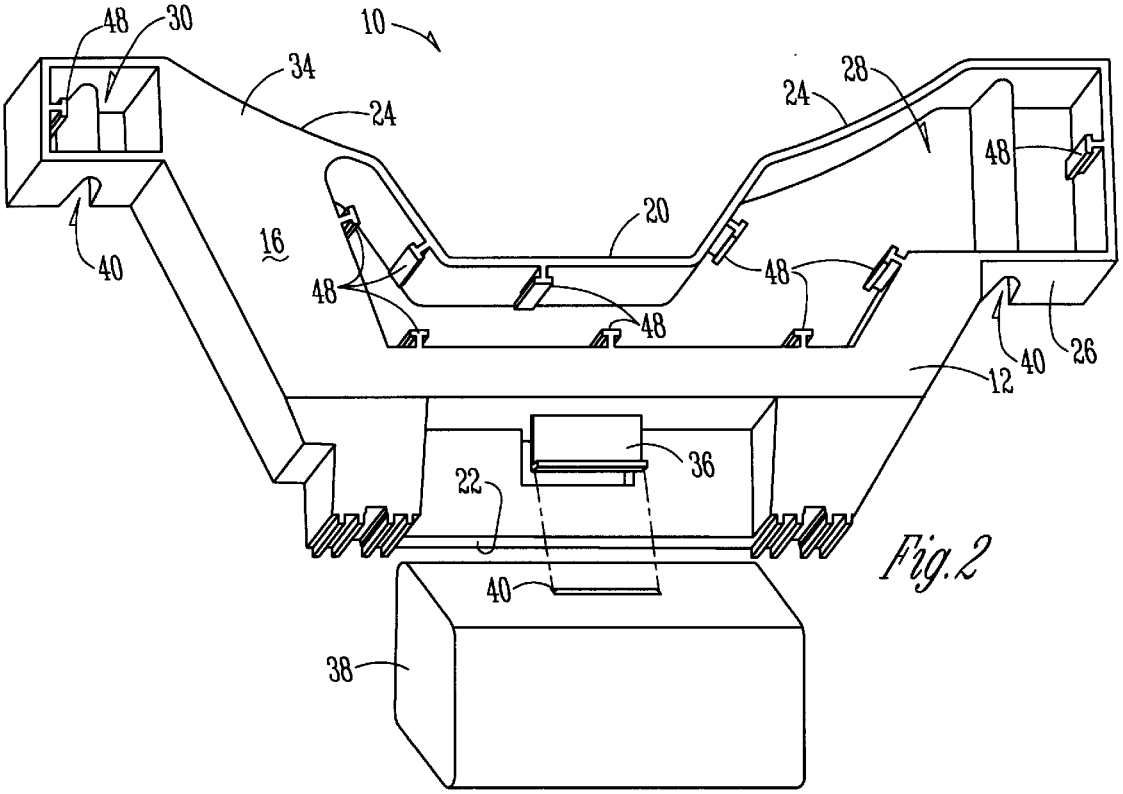
FIG. 2 is an exploded perspective view of the plastic shell and impact member of the counterbalance weight.

As seen in FIG. 2, the plastic shell 26 includes a plurality of projections which extend inwardly from the perimeter of the cavities 28, 30. Preferably, the projections 48 are T-shaped. As the concrete is poured into the cavities 28, 30, the concrete consolidates around the projections 48, thereby providing a mechanical lock between the plastic shell 26 and the hardened concrete 32. Thus, if the concrete cracks or breaks, the projections 48 will retain the concrete in the plastic shell 26.

Figure 7:
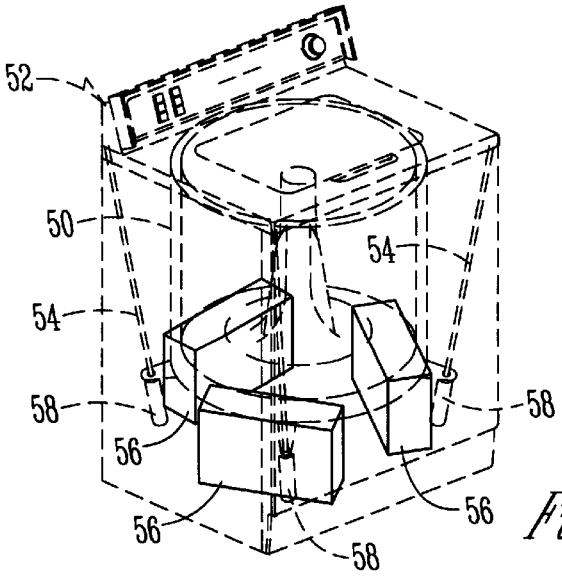
FIG. 7 is a view of an alternative embodiment wherein an impact-absorbing member is mounted on the bottom of a hung strut tub.

An alternative embodiment is shown in FIG. 7, wherein a tub 50 in a hung strut washing machine 52. The tub 50 and struts 54 have conventional construction. One or more impact-absorbing members 56 are mounted to the bottom of the tub 50 so as to absorb shock during transportation and so as to limit the downward movement of the tub during use of the machine 52. In the absence of the impact members 56, upon excessive loading of the tub 50, the springs 58 at the lower ends of the struts 54 become fully compressed, thereby eliminating the ability of the springs to absorb vibrations during operation. By limiting the downward movement of the tub 50, the impact-absorbing members 56 assure that the springs 58 do not become fully compressed, thereby maintaining the vibration absorbing function of the springs 58.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. An improved laundry washing machine for washing laundry, the improvement comprising:

a vertically oriented tub with an open top, a closed bottom, and a side wall; and an impact-absorbing member secured and maintained in the machine during normal use to absorb impact to the tub and to limit the downward movement of the tub.

2. The washing machine of claim 1 wherein the impact absorbing member is foam.

3. The washing machine of claim 1 further comprising a plurality of struts for supporting the tub, and springs on the struts for absorbing vibrations during operation of the machine, the impact-absorbing member being sufficiently large to maintain the vibration absorbing function of the springs during normal operation.

4. The washing machine of claim 3 wherein the springs are compression springs, and the impact-absorbing members preclude complete compression of the springs during normal operation of the machine.

5. The washing machine of claim 1 wherein the impact-absorbing member is mounted to the bottom of the tub.

6. A method of operating a washing machine having a cabinet and a vertically oriented tub with an open top and a closed bottom, the method comprising:

suspending the tub with a plurality of spring loaded hung struts within the cabinet;

positioning at least one impact-absorbing member between the bottom of the tub and the cabinet; and limiting the downward movement of the tub with the impact-absorbing member during normal use of the machine.

7. The method of claim 6 further comprising maintaining vibration absorption by the springs during normal use of the machine.

8. The method of claim 6 further comprising precluding complete compression of the springs.

9. The method of claim 6 further comprising mounting the impact-absorbing member to the bottom of the tub.

* * * * *